US007841588B2

(12) United States Patent
Kellner et al.

(10) Patent No.: US 7,841,588 B2
(45) Date of Patent: Nov. 30, 2010

(54) STAND WITH A DAMPING ELEMENT

(75) Inventors: Frank Kellner, Bad Hersfeld (DE); Hans Moll, Huenfeld (DE)

(73) Assignee: Ondal Holding GmbH, Hunfeld (DE)

( * ) Notice: Subject to any disclaimer, the term of this patent is extended or adjusted under 35 U.S.C. 154(b) by 1015 days.

(21) Appl. No.: 11/601,241

(22) Filed: Nov. 17, 2006

(65) Prior Publication Data

US 2007/0182075 A1 Aug. 9, 2007

(30) Foreign Application Priority Data

Nov. 24, 2005 (EP) ..... 05025612

(51) Int. Cl.
*A47C 7/14* (2006.01)

(52) U.S. Cl. ..... 267/131; 267/64.26; 248/566

(58) Field of Classification Search ..... 267/131, 267/136, 137, 140.11, 142, 64.11, 64.14, 267/64.18, 64.26, 64.28; 248/560, 566
See application file for complete search history.

(56) References Cited

U.S. PATENT DOCUMENTS 1,782,660 A * 11/1930 Meyer ..... 248/413
2,334,489 A * 11/1943 Higgins ..... 34/90
3,989,211 A * 11/1976 Gundlach ..... 248/162.1
4,108,416 A * 8/1978 Nagase et al. ..... 248/566
5,020,752 A * 6/1991 Rizzi et al. ..... 248/162.1
5,098,120 A * 3/1992 Hayashi et al. ..... 267/276
5,131,615 A * 7/1992 Hosan et al. ..... 248/161
2004/0173954 A1* 9/2004 Pooschen ..... 267/64.11

FOREIGN PATENT DOCUMENTS

DE EP-001374725 A1 * 1/2004

* cited by examiner

*Primary Examiner*—Pam Rodriguez
(74) *Attorney, Agent, or Firm*—Seed IP Law Group PLLC

(57) ABSTRACT

In order to provide a damping element (4) in compact form for transportation as an individual part of a dismantled stand (1) and to be able to push a support (11) into a tube (2) to fix it there, it is proposed that the support (11) is relatively, in particular vertically and telescopically, displaceable with respect to tube (2), in that damping element (4) is connected at a first end (19) on support (11) to a component (20) for holding the appliance, in that damping element (4) is held by tube (2), in that a second, opposite end (21) of damping element (4) protrudes out of tube (2) when damping element (4) is relaxed, in that the second end (21) of damping element (4) can be shifted onto tube (2) or into it when damping element (4) is compressed, and in that second end (21) can be fastened in this compressed state by a fixing element (22) to fix support (11) in its position shifted towards tube (2).

21 Claims, 8 Drawing Sheets

STAND WITH A DAMPING ELEMENT

The subject matter of the application relates to a stand with a support, in particular for supporting a hairdressing appliance, and with a damping element for damping the weight of the appliance, the appliance loading the damping element, and the damping element being compressible with regard to its length.

Stands of this type are known. They serve, for example in hairdressing salons, for holding hairdryers. While the damping element is relaxed and is therefore relatively long in the unloaded state, a loading of the damping element by the weight of the hairdressing appliance results in a compressing of the damping element and therefore in it becoming shorter. The damping element serves as a power-assisting means for simple lifting and lowering of the appliance in the vertical direction.

The known stands have the disadvantage that their damping element is relatively long when the stand is dismantled into its individual parts, which results in a relatively high consumption of packaging material for the component which is to be transported and which has the damping element.

The object is to eliminate this disadvantage.

This object is achieved in that the support is relatively, in particular telescopically, displaceable with respect to a tube, in that the damping element is connected at a first end on the support to a component for holding the appliance, in that a tube which holds the damping element is provided, in that a second, opposite end of the damping element protrudes out of the tube when the damping element is relaxed, in that the second end of the damping element can be shifted onto the tube or into it when the damping element is compressed, and in that the second end can be fastened in this compressed state by means of a fixing element in order there to fix the support which has been shifted relatively towards the tube.

The proposed stand has the advantage that the support can be shifted relative to the tube, with it being possible for the damping element to be compressed and to be fixed on or in the tube in the compressed state. As a result, the part which is to be transported is more easily handled and requires less packaging material. During transportation, the support is situated on or in the tube in a compact manner. As a result, that part of the stand which has the tube and the support is significantly shorter than if the support had not been shifted relative to the tube. Furthermore, the damping element is locked in place during transportation. The fixing element serves to lock the damping element in place in the compressed state and can be designed in a wide variety of ways.

If a screw is provided at the second end of the tube, with a securing nut being screwed onto the screw, part of the securing nut, preferably a gripping part of the securing nut, forms the fixing element, and the gripping part thus retains the compressed damping element, thus achieving a simple and reliable fixing element. The gripping part acts counter to an end surface of the compressed damping element and prevents the damping element from relaxing.

If the screw is formed at the end of a rod which is connected to the component for holding the appliance and extends parallel to the damping element, then the damping element and the support can be fixed by the securing nut being screwed onto the screw. In this case, the securing nut prevents the damping element from expanding and therefore prevents the support from being reset into a position remote from the tube. The securing nut, per se, or just a gripping part of relatively large diameter that is provided on it can lock the damping element in place.

The gripping part can be rotated manually in a simple manner if it is provided outside the tube and on the latter. In this case, the gripping part securely fixes the damping element if an upper edge of the gripping part is supported on a lower edge of the tube.

A gas-filled compression spring is suitable as a reliable damping element.

If the fixing element has two internal threads, then one internal thread can be used for screwing on the fixing element and therefore for locking the damping element in place and the other internal thread can be used for another purpose, for example after rotation of the fixing element through 180 degrees. This other purpose may be the connecting of the damping element to a foot of the stand. The securing nut of the fixing element serves for this purpose. To this end, a pin which is connected to the damping element and has an external thread is inserted through an opening in the foot. The external thread of the pin, which external thread protrudes out of the foot, is then provided, with the second internal thread being used, in particular after the fixing element is turned, by the fixing element being screwed on, with the securing nut in order to connect the end of the damping element to the foot.

The proposed innovation is explained in more detail below with reference to figures which illustrate an exemplary embodiment.

Figure 1:
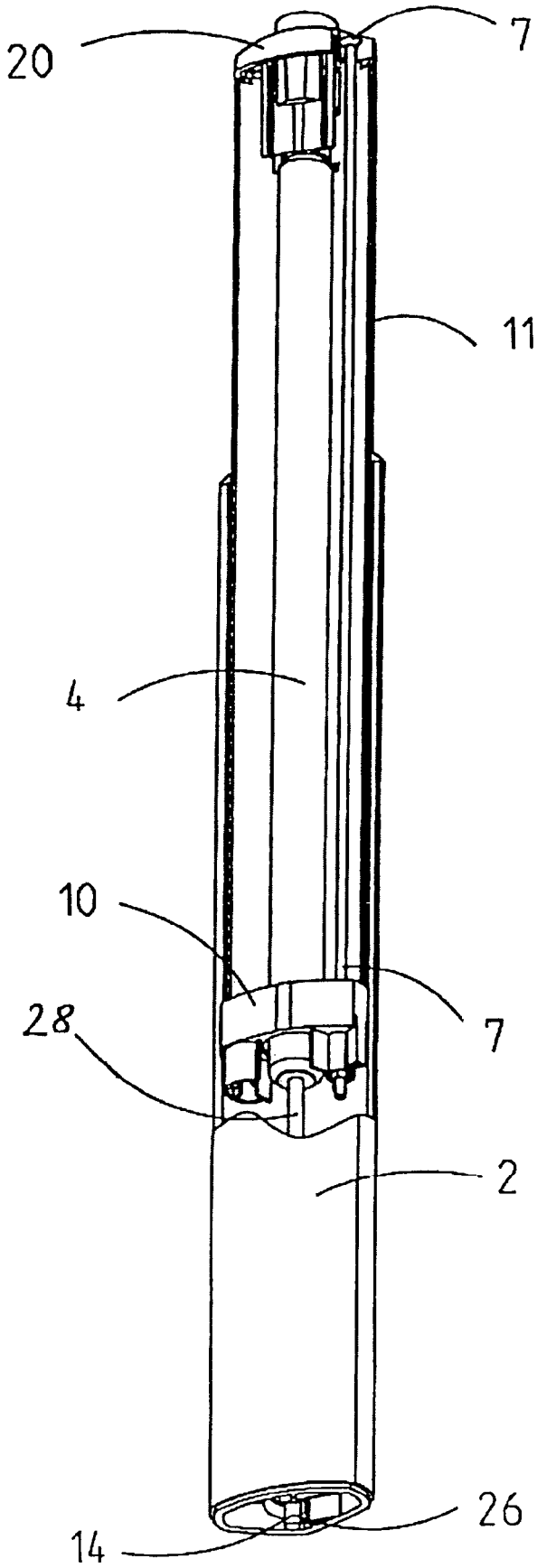
FIG. 1 shows, in a perspective view, a tube which is a vertical component of a stand, with a relaxed damping element, which is arranged in the tube and protrudes downwards out of the latter, and with a screw which runs parallel to the damping element.
Figure 2:
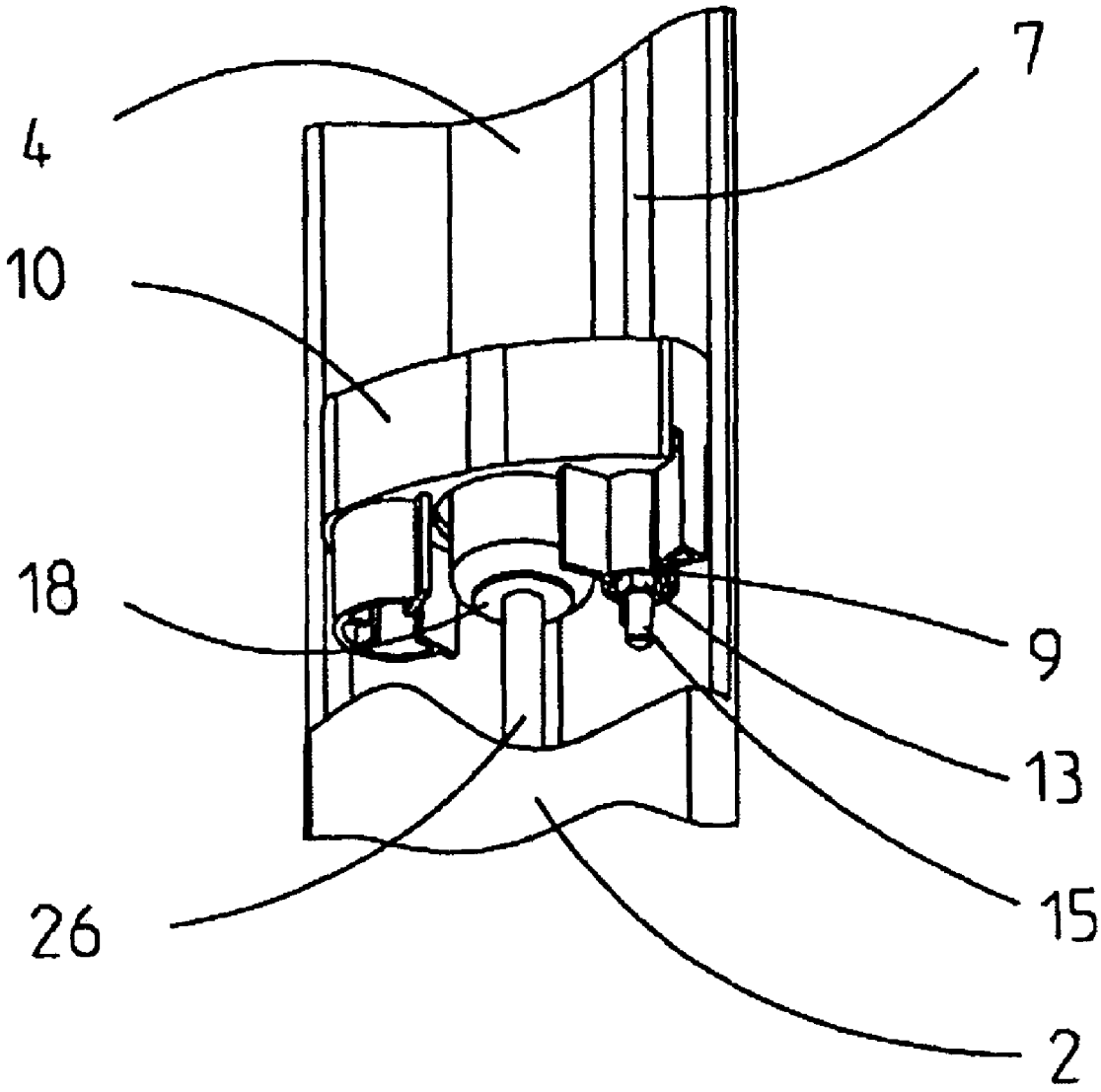
FIG. 2 shows a cutout from FIG. 1 in an enlarged illustration.
Figure 3:
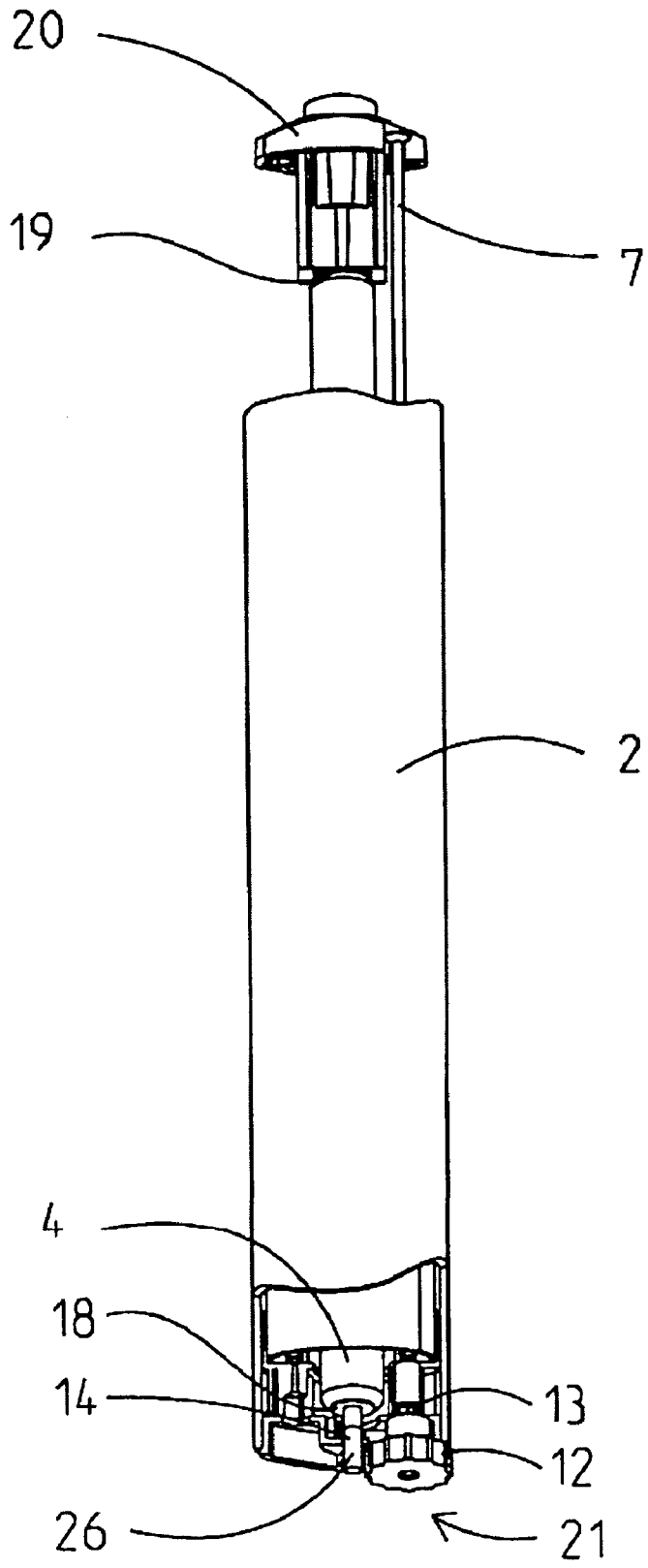
FIG. 3 shows, in a partial sectional illustration, the lower region of the tube of FIG. 1, but with the damping element reset and with a fixing element which is screwed onto the screw and comprises a securing nut and a gripping part connected to the latter.
Figure 4:
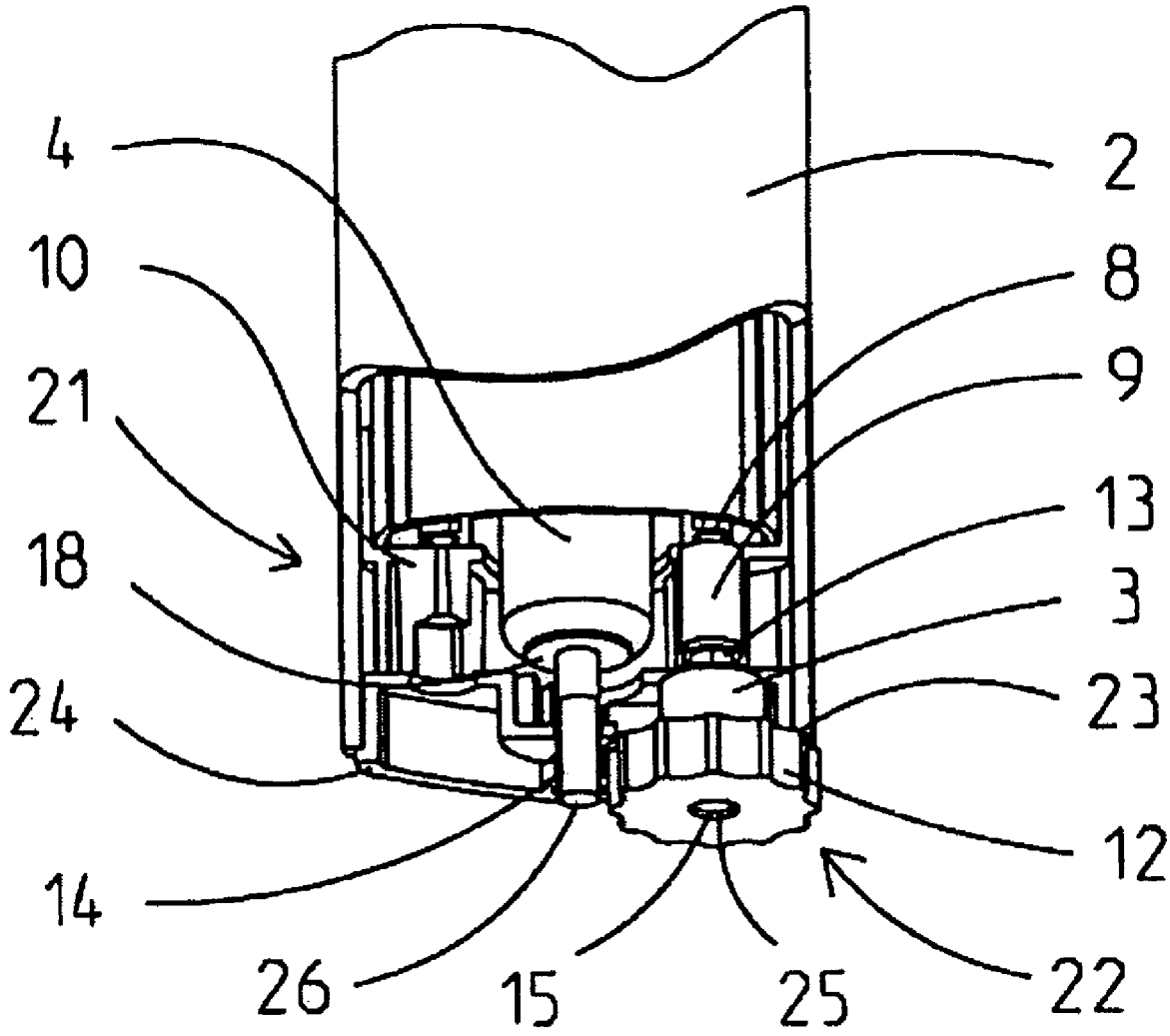
FIG. 4 shows a cutout from FIG. 3 in an enlarged illustration.
Figure 5:
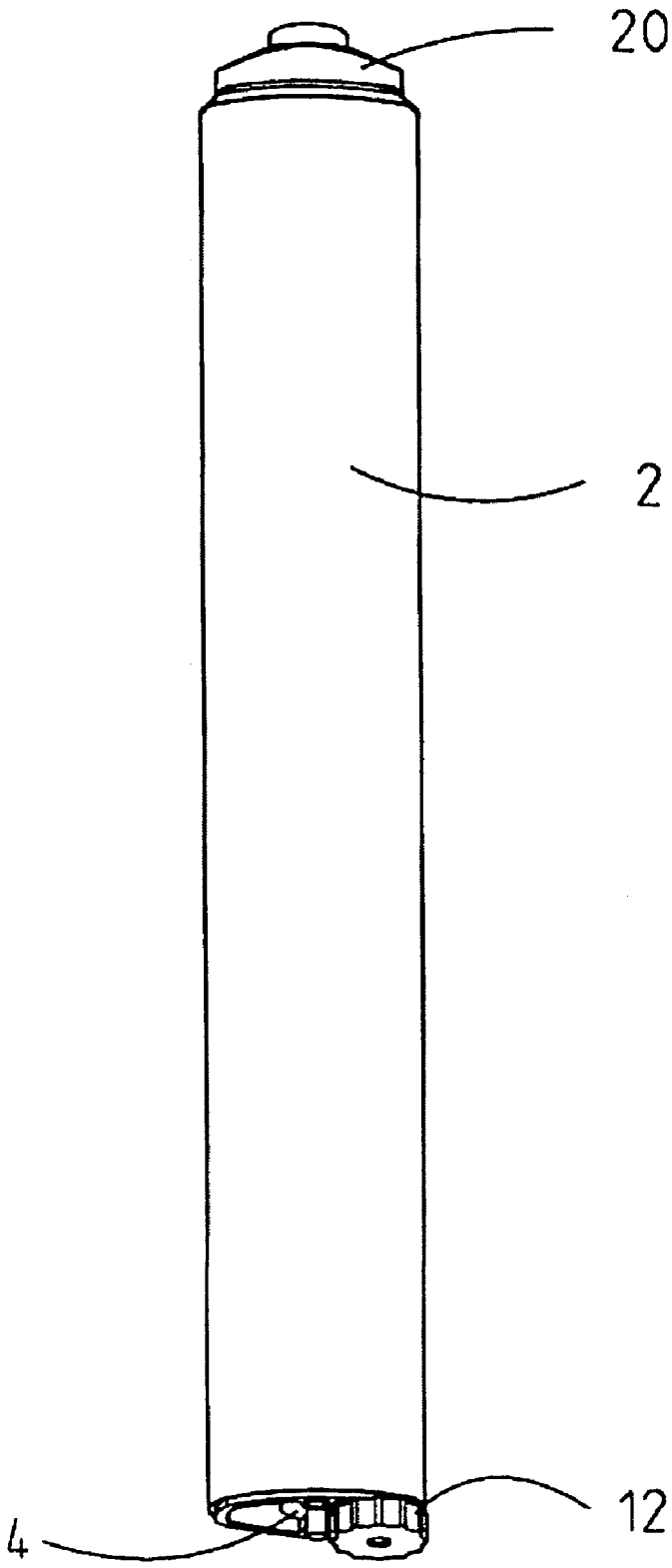
FIG. 5 shows, in a perspective view, the tube of FIG. 1 with the reset and fixed damping element according to FIG. 4.
Figure 6:
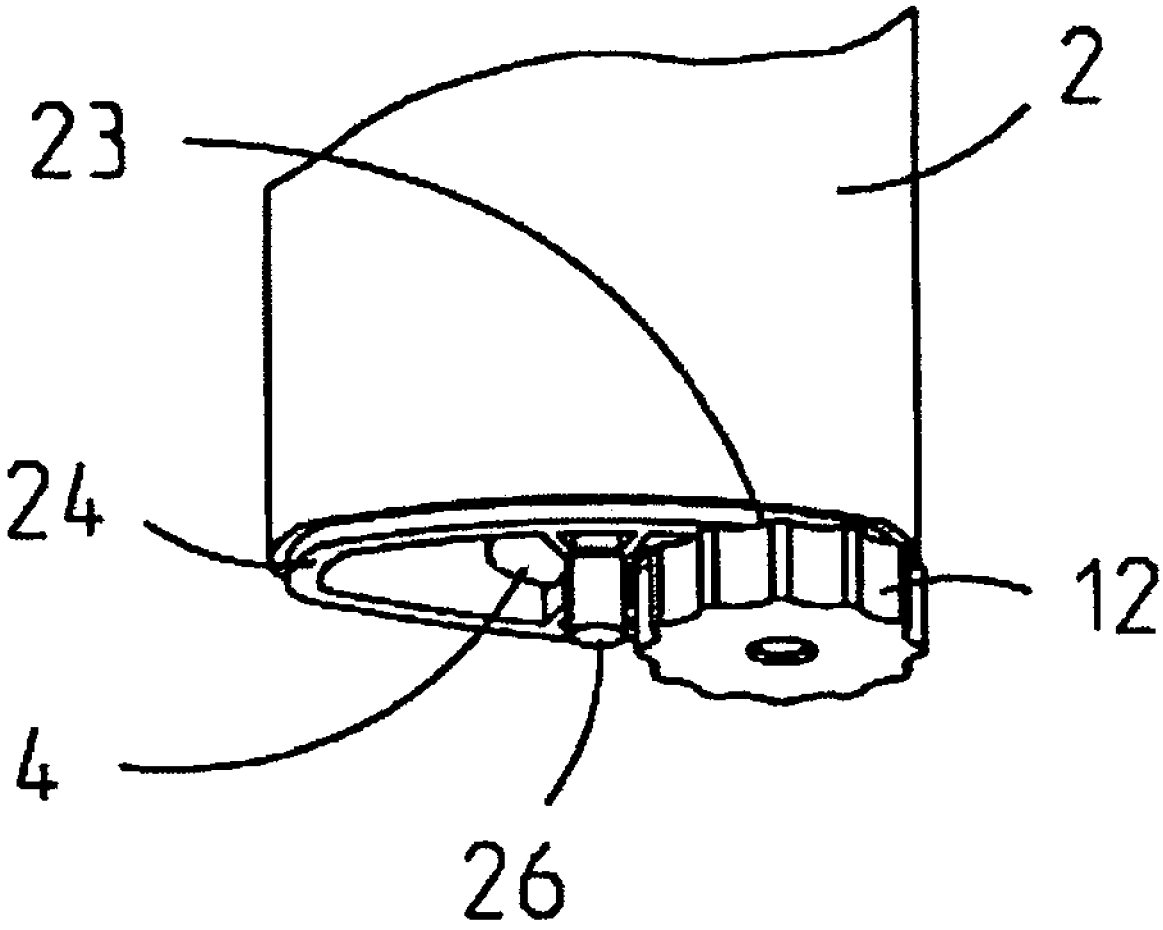
FIG. 6 shows, in a perspective view and in an enlargement, the lower region of the tube of FIG. 5.
Figure 9:
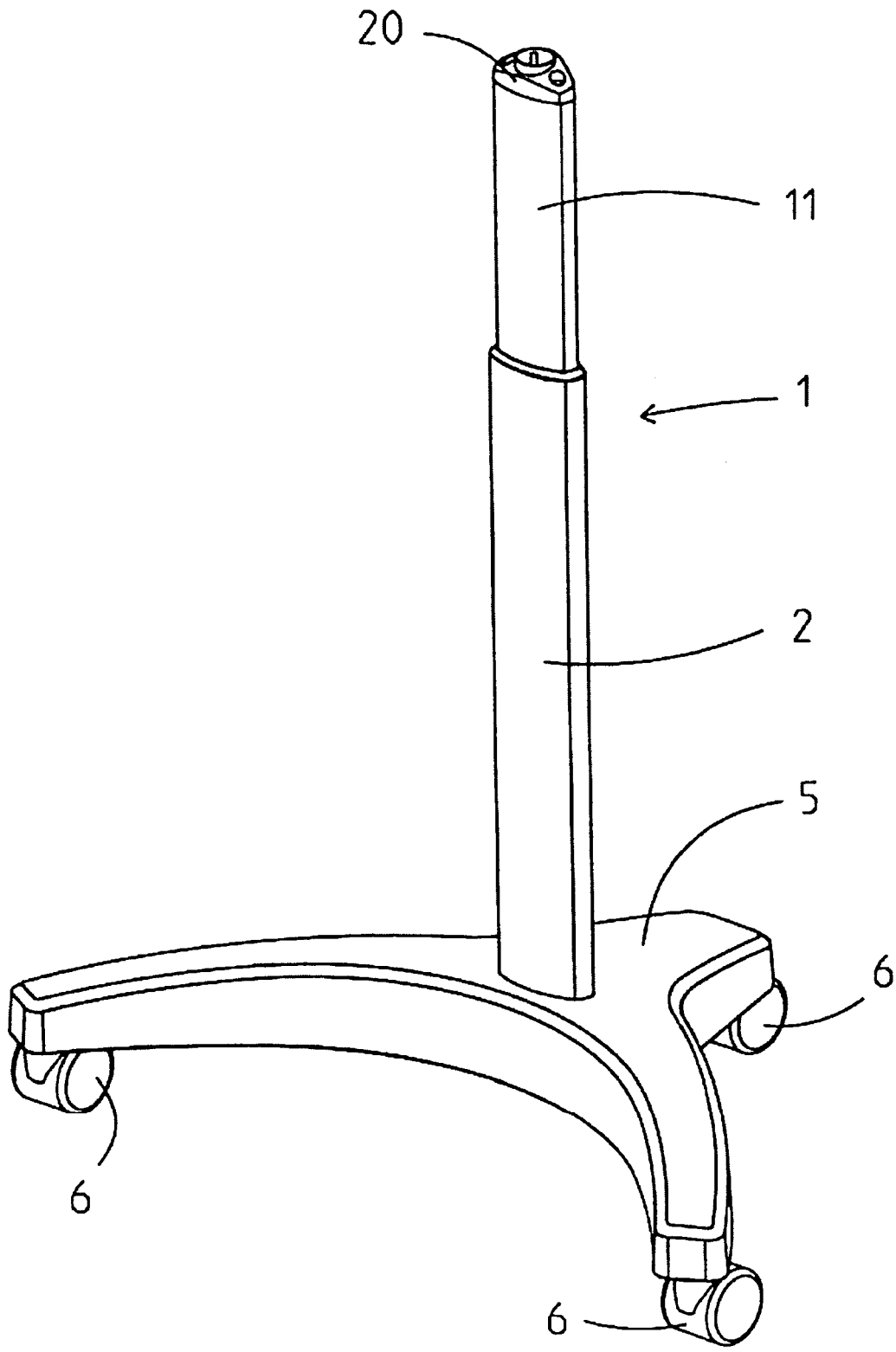
FIG. 9 shows the complete stand in a perspective view, with a vertically aligned support which loads the damping element having been placed onto the tube which contains the damping element.

In the case of a stand 1 (FIG. 9), a support 11 serves to support a hairdressing appliance. A damping element 4 is provided for damping the weight of the appliance, the appliance loading the damping element 4, and the damping element 4 being compressible with regard to its length (FIG. 3, FIG. 4). The damping element 4 is connected at a first end 19 to a component 20 which is provided on a tube 2 holding the damping element 4 (FIG. 1, FIG. 2). A second, opposite end 21 of the damping element 4 protrudes out of the tube 2 when the damping element 4 is relaxed. The second end 21 of the damping element 4 can be shifted into the tube 2 by compression (FIG. 4). The second end 21 can be fastened in this compressed state by means of a fixing element 22. The damping element 4, which is pressed back into the tube 2, is designed as a gas-filled compression spring and has a piston rod 28, is fixed in the pressed-back state in order to design the construction unit, which is encased by the tube 2, in a manner such that it is compact for transportation, with the support 11 pushed telescopically into the tube 2. To this end, a screw 8 is provided on the tube 2. A screw nut 3 is screwed onto the screw 8 when the support 11 is pushed in. A gripping part 12 of the securing nut 3 forms the fixing element 22 for retaining an end surface 18 of the damping element 4. The screw 8 is formed at the end of a rod 7 which is connected to a component 20 of the support 11. The rod 7 extends parallel to the damping element 4. The gripping part 12 is provided outside the tube 2 and on the latter (FIG. 5, FIG. 6). An upper edge 23 of the gripping part 12 is supported on a lower edge 24 of the tube 2 in order to prevent the support 11 from passing back into its position illustrated in FIG. 1.

Figure 7:
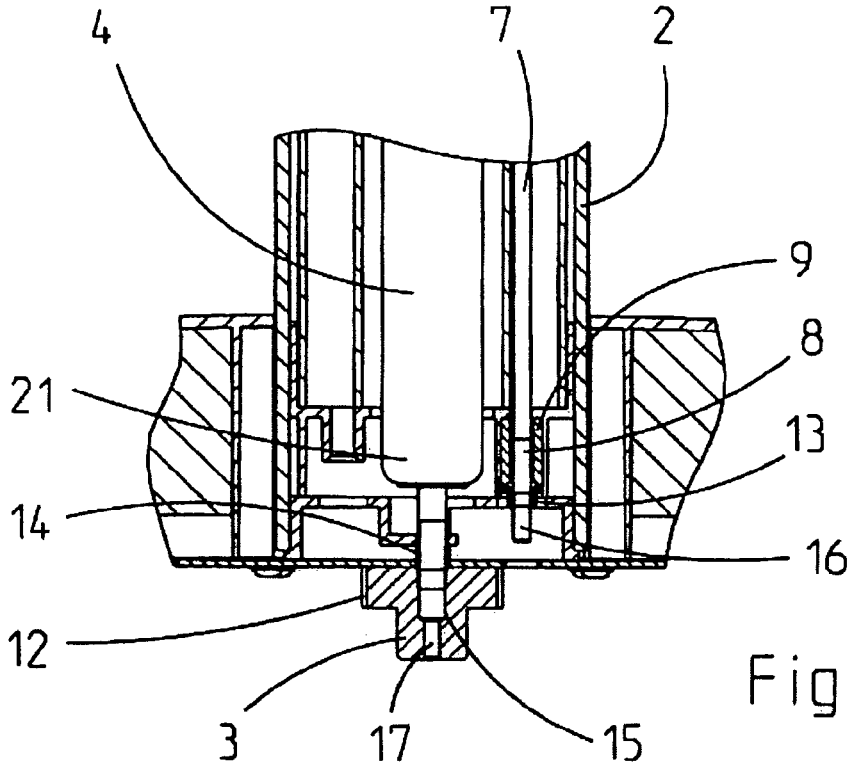
FIG. 7 shows, in a sectional illustration, the lower region of the tube which is placed onto a foot of the stand, with the fixing element having been unscrewed and turned from the external thread of the screw and, after being screwed onto an external thread of a pin, which is fitted at the bottom to the damping element, serving as a fastening element for fastening the damping element on the foot.
Figure 8:
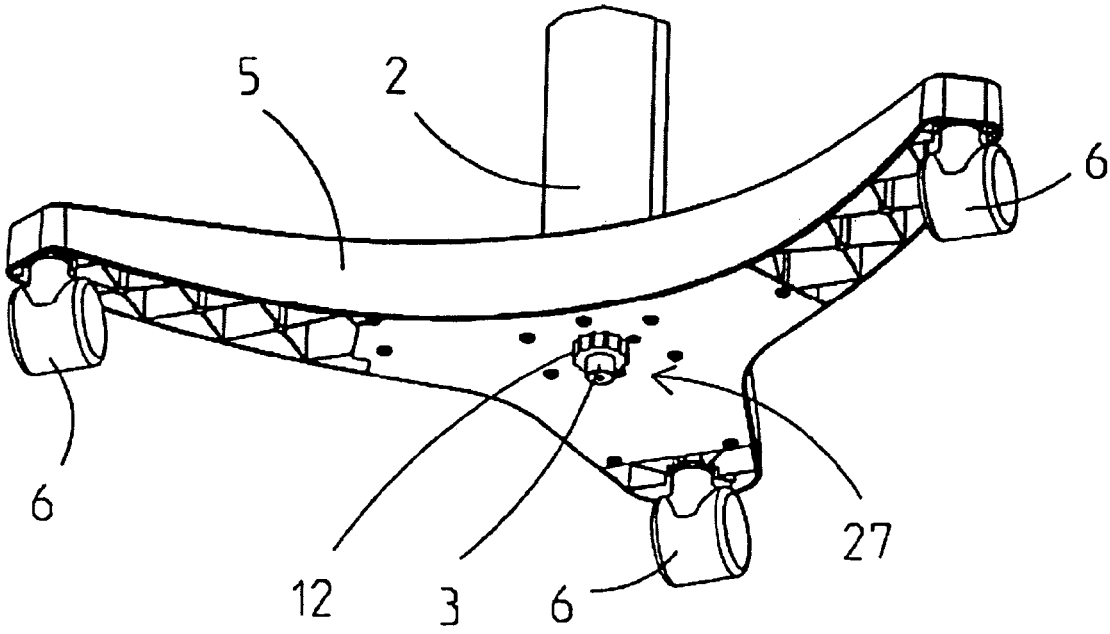
FIG. 8 shows, in a perspective view, the lower region of the tube with the foot of the stand according to FIG. 7.

In order to release the transportation locking carried out by the fixing element 22 and subsequently to fasten the damping element 4 to a foot 5 of the stand 1, the fixing element 22 is unscrewed from the screw 8 and, after the tube 2 is placed onto the foot 5, is used in a turned-round position for screwing the damping element 4 onto the foot 5 (FIG. 7, FIG. 8). For this purpose, the fixing element 22 has an axial opening 25 in which two internal threads 15,17 are provided axially one behind the other. One internal thread 17 fits onto the external thread 16 of the screw 8 and the other internal thread 15 fits onto an external thread 14 of a pin 26 which is connected to the lower end 21 of the damping element 4. The securing nut 3 serves to connect the second end 21 to a foot 5 of the stand 1, since the pin 26 can be inserted through an opening 27 in the foot 5, and the external thread 14 of the pin 26, which external thread protrudes out of the foot 5, is provided with the securing nut 3 in order to connect the end 21 to the foot 5. The foot 5 is moveable by means of castors 6.

1 Stand
2 Tube
3 Securing nut
4 Damping element
5 Foot
6 Castor
7 Rod
8 Screw
9 Buffer
10 Securing means
11 Support
12 Gripping part
13 Nut
14 External thread
15 Internal thread
16 External thread
17 Internal thread
18 End surface
19 End, first
20 Component
21 End, second
22 Fixing element
23 Upper edge
24 Lower edge
25 Axial opening
26 Pin
27 Opening
28 Piston rod The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. Stand comprising:

a support for supporting a hairdressing appliance, a damping element for damping the weight of the appliance, wherein the appliance in use loads the damping element, the damping element being compressible with regard to its length, and a tube which holds the damping element, wherein the support is telescopically displaceable with respect to the tube, wherein the damping element is connected at a first upper end on the support to a component for holding the appliance, wherein a second, opposite end of the damping element protrudes out of the tube when the damping element is relaxed, and wherein the second end of the damping element can be shifted onto the tube or into it when the damping element is compressed, wherein the second end of the damping element is configured to be fastened by means of a fixing element at a corresponding end of the tube in order to fix the support with the damping element in the compressed state in its position shifted towards or into the tube.

2. Stand according to claim 1, wherein a screw is provided in the region of the second end of the damping element, and wherein a securing nut is screwed onto the screw, such that at least part of the securing nut forms the fixing element.

3. Stand according to claim 2, wherein the screw is formed at the end of a rod which extends parallel to the damping element and which is connected to the component for holding the appliance.

4. Stand according to claim 2, wherein a gripping part of the securing nut is provided outside of the tube and on the latter.

5. Stand according to claim 4, wherein an upper edge of the gripping part is supported on a lower edge of the tube.

6. Stand according to claim 2, wherein the fixing element has an axial opening in which two internal threads are provided, one internal thread fitting onto an external thread of the screw and the other internal thread fitting onto an external thread of a pin which is connected to the second end of the damping element.

7. Stand according to claim 6, wherein the securing nut serves to connect the second end of the damping element to a foot of the stand, the pin being insertable through an opening in the foot, and the external thread of the pin, which external thread protrudes out of the foot, being provided with the securing nut in order to connect the second end of the damping element to the foot.

8. Stand according to claim 6, wherein the two internal threads in the axial opening of the fixing element are provided axially one behind the other.

9. Stand according to claim 1, wherein the damping element is designed as a gas-filled compression spring.

10. Stand according to claim 1, wherein the fixing element is configured to connect the damping element to a foot of the stand after the support is released from the compressed state in the tube.

11. Stand comprising:

a support for supporting a hairdressing appliance;

a damping element for damping the weight of the appliance which, in use, loads the damping element, the damping element being compressible with respect to its length; and a tube which holds the damping element;

wherein the support is telescopically displaceable with respect to the tube, wherein a first upper end of the damping element is connected to a component provided on the support for holding the appliance and protrudes out of the tube when the damping element is relaxed, wherein a second, opposite end of the damping element can be shifted onto or into the tube when the damping element is compressed, and wherein the second end of the damping element is configured to be fastened by means of a fixing element at a corresponding end of the tube to fix the support with the damping element in the compressed state in its position shifted into the tube.

12. Stand according to claim 11, wherein a screw is provided in the region of the second end of the damping element, wherein the fixing element comprises at least part of a securing nut which is screwed onto the screw.

13. Stand according to claim 12, wherein the screw is formed at the end of a rod which extends parallel to the damping element and which is connected to the component for holding the appliance.

14. Stand according to claim 12, wherein the securing nut is attached to the screw at an end of the tube.

15. Stand according to claim 14, wherein an upper edge of a gripping part of the securing nut is supported on a lower edge of the tube.

16. Stand according to claim 12, wherein the fixing element has an axial opening in which two internal threads are provided, wherein one internal thread fits onto an external thread of the screw and the other internal thread fits onto an external thread of a pin connected to the second end of the damping element.

17. Stand according to claim 16, wherein the fixing element serves to connect the damping element to a foot of the stand, the pin being insertable through an opening in the foot, and the external thread of the pin, which protrudes out of the foot, being provided with the fixing element to connect the second end of the damping element to the foot.

18. Stand according to claim 16, wherein the two internal threads in the axial opening of the fixing element are provided axially one behind the other.

19. Stand according to claim 11, wherein the damping element is designed as a gas-filled compression spring.

20. Stand according to claim 11, wherein the fixing element is configured to connect the damping element to a foot of the stand after the support is released from the compressed state in the tube.

21. Stand according to claim 11, wherein the support is disposed within the tube and is vertically displaceable therein.

* * * * *